US010871072B2

(12) United States Patent
Mehra

(10) Patent No.: US 10,871,072 B2
(45) Date of Patent: Dec. 22, 2020

(54) SYSTEMS AND METHODS FOR DYNAMIC BALANCING OF STEAM TURBINE ROTOR THRUST

(71) Applicant: General Electric Company, Schenectady, NY (US)

(72) Inventor: Mahendra Singh Mehra, Greater Noida (IN)

(73) Assignee: General Electric Company, Schenectady, NY (US)

( * ) Notice: Subject to any disclaimer, the term of this patent is extended or adjusted under 35 U.S.C. 154(b) by 358 days.

(21) Appl. No.: 15/582,832

(22) Filed: May 1, 2017

(65) Prior Publication Data

US 2018/0313215 A1 Nov. 1, 2018

(51) Int. Cl.
*F01D 3/04* (2006.01)
*F01D 17/10* (2006.01)
(Continued)

(52) U.S. Cl.
CPC ..... *F01D 3/04* (2013.01); *F01D 17/10* (2013.01); *F01D 17/145* (2013.01); *F01D 17/24* (2013.01); *F01D 25/168* (2013.01); *F05D 2220/31* (2013.01); *F05D 2240/52* (2013.01); *F05D 2260/15* (2013.01)

(58) Field of Classification Search
CPC ..... F05D 2220/31; F05D 2240/52; F05D 2260/15; F01D 3/00; F01D 3/04; F01D 17/10; F01D 17/145; F01D 25/168
See application file for complete search history.

(56) References Cited

U.S. PATENT DOCUMENTS 3,921,406 A * 11/1975 Teranishi ..... F01K 7/40 60/660
4,403,476 A * 9/1983 Johnson ..... F01D 17/105 60/652

(Continued)

FOREIGN PATENT DOCUMENTS

JP 61089911 A * 5/1986 ..... F01D 17/145

OTHER PUBLICATIONS

International Search Report and Written Opinion issued in connection with corresponding PCT Application No. PCT/US2018/023942 dated Jul. 12, 2018.

*Primary Examiner* — John M Zaleskas
(74) *Attorney, Agent, or Firm* — Eversheds Sutherland (US) LLP

(57) ABSTRACT

The present application provides a steam turbine system. The steam turbine system may include a rotor, a high pressure section positioned about the rotor, one or more high pressure extraction conduits extending from the high pressure section, a high pressure control valve positioned on each of the high pressure extraction conduits, an intermediate pressure section positioned about the rotor, one or more intermediate pressure extraction conduits extending from the intermediate pressure section, an intermediate pressure control valve positioned on each of the intermediate pressure extraction conduits, and a controller in communication with the high pressure control valves and the intermediate pressure control valves and operable to selectively adjust respective positions of the high pressure control valves and the intermediate pressure control valves to balance thrust acting on the rotor.

18 Claims, 3 Drawing Sheets

(51) Int. Cl.

| | |
|---|---|
| ***F01D 25/16*** | (2006.01) |
| ***F01D 17/24*** | (2006.01) |
| ***F01D 17/14*** | (2006.01) |

(56) References Cited

U.S. PATENT DOCUMENTS

| | | | | |
|---|---|---|---|---|
| 4,917,570 | A * | 4/1990 | Pankowiecki | F01D 3/00 137/565.35 |
| 5,914,537 | A * | 6/1999 | Zaviska | F01K 13/02 290/40 R |
| 6,705,086 | B1 * | 3/2004 | Retzlaff | F01D 1/023 60/653 |
| 6,892,540 | B1 * | 5/2005 | Tisenchek | F01D 3/02 60/645 |
| 6,957,945 | B2 | 10/2005 | Tong et al. | |
| 8,197,182 | B2 | 6/2012 | Hernandez | |
| 8,480,352 | B2 | 7/2013 | Zheng et al. | |
| 8,568,084 | B2 | 10/2013 | Zheng et al. | |
| 8,650,878 | B2 | 2/2014 | Mehra et al. | |
| 9,341,073 | B2 | 5/2016 | Donnelly | |
| 2004/0101395 | A1 * | 5/2004 | Tong | F01D 3/04 415/1 |
| 2006/0140747 | A1 | 6/2006 | Vandervort et al. | |
| 2008/0003095 | A1 * | 1/2008 | Tisenchek | F01D 3/00 415/13 |
| 2010/0000216 | A1 * | 1/2010 | Hofer | F01K 13/02 60/645 |
| 2010/0158666 | A1 * | 6/2010 | Hernandez | F01D 3/02 415/93 |
| 2011/0110759 | A1 * | 5/2011 | Sanchez | F02C 6/04 415/1 |
| 2011/0314817 | A1 * | 12/2011 | Zheng | F01D 3/02 60/661 |
| 2011/0318169 | A1 * | 12/2011 | Zheng | F01D 11/025 415/169.1 |
| 2012/0017592 | A1 * | 1/2012 | Maruyama | F01D 3/04 60/645 |
| 2012/0174584 | A1 * | 7/2012 | Bennauer | F01K 7/22 60/657 |
| 2012/0255309 | A1 * | 10/2012 | Venetos | F03G 6/065 60/772 |
| 2012/0266598 | A1 * | 10/2012 | Goto | F01K 7/223 60/679 |
| 2013/0142618 | A1 * | 6/2013 | Chernysheva | F01D 25/12 415/1 |
| 2013/0340405 | A1 * | 12/2013 | Sackmann | F01K 17/025 60/39.182 |
| 2014/0102097 | A1 * | 4/2014 | Cornell | F01K 7/04 60/645 |
| 2014/0373541 | A1 * | 12/2014 | Kato | F01K 7/04 60/646 |
| 2015/0044024 | A1 * | 2/2015 | Donnelly | F01D 3/04 415/36 |
| 2015/0218970 | A1 * | 8/2015 | Ahn | F01K 7/04 60/645 |
| 2015/0218974 | A1 * | 8/2015 | Florey | F01D 3/04 415/36 |

* cited by examiner

SYSTEMS AND METHODS FOR DYNAMIC BALANCING OF STEAM TURBINE ROTOR THRUST

TECHNICAL FIELD

The present application relates generally to steam turbines and more particularly relates to systems and methods for dynamic balancing of steam turbine rotor thrust.

BACKGROUND OF THE INVENTION

A steam turbine may include a number of sections, such as a high pressure section, an intermediate pressure section, and a low pressure section, configured to extract work from steam flowing therethrough. The high pressure section, the intermediate pressure section, and the low pressure section may be positioned about a common rotor of the steam turbine and configured to rotate the rotor. During operation of the steam turbine, thrust may be developed by each of the high pressure section, the intermediate pressure section, and the low pressure section, and the sum of these thrust values may result in a net thrust acting on the rotor of the steam turbine.

Certain steam turbines may include a thrust bearing that is supported by a stationary support structure of the steam turbine and configured to interact with a thrust piston about the rotor of the steam turbine. In this manner, the thrust bearing and the thrust piston may balance the net thrust acting on the rotor, thereby allowing for safe operation of the steam turbine. Although existing thrust bearing configurations may provide adequate balancing and control of steam turbine rotor thrust during normal operations, certain challenges may exist in balancing the net thrust of the steam turbine during transient operations. Example transient operations may include an overload valve of the steam turbine being in a fully open position, partial arc operation in a control stage of the high pressure section, and heaters of the steam turbine being in an off state. Transient operations may result in significant increases in steam turbine rotor thrust, for example, absolute thrust (+/−) may rise above 200 kN, which may result in damage to the thrust bearing. In order to inhibit such damage, certain steam turbines may use a high thrust load bearing or a larger bearing area (i.e., a larger diameter thrust piston and thrust bearing). However, the use of a high thrust load bearing may increase the cost of the steam turbine, and the use of a larger bearing area may increase leakage from the thrust piston and thus decrease efficiency of the steam turbine. Moreover, even when implementing these measures, a turbine trip sometimes may occur due to high thrust, which may impact availability of the power plant.

There is thus a desire for improved systems and methods for balancing of steam turbine rotor thrust during both normal operations and transient operations. Such systems and methods may provide dynamic balancing of steam turbine rotor thrust in a cost-effective manner that minimizes mechanical losses of the steam turbine and improves the heat rate. Additionally, such systems and methods may allow for the use of a conventional thrust bearing in a size that minimizes leakage from the thrust piston and thus provides improved efficiency of the steam turbine. Furthermore, such systems and methods may inhibit damage to the thrust bearing and allow the steam turbine to operate in a safe and reliable manner.

SUMMARY OF THE INVENTION

The present application thus provides a steam turbine system. The steam turbine system may include a rotor, a high pressure section positioned about the rotor, one or more high pressure extraction conduits extending from the high pressure section and configured to direct one or more high pressure extraction flows of steam, a high pressure control valve positioned on each of the high pressure extraction conduits, an intermediate pressure section positioned about the rotor, one or more intermediate pressure extraction conduits extending from the intermediate pressure section and configured to direct one or more intermediate pressure extraction flows of steam, an intermediate pressure control valve positioned on each of the intermediate pressure extraction conduits, and a controller in communication with the high pressure control valves and the intermediate pressure control valves. The controller may be operable to selectively adjust respective positions of the high pressure control valves and the intermediate pressure control valves to balance thrust acting on the rotor.

The present application further provides a method for balancing steam turbine rotor thrust. The method may include the steps of operating a steam turbine including a rotor, a high pressure section positioned about the rotor, and an intermediate pressure section positioned about the rotor, directing one or more high pressure extraction flows of steam via one or more high pressure extraction conduits, and directing one or more intermediate pressure extraction flows of steam via one or more intermediate pressure extraction conduits. The method also may include the step of selectively adjusting, via a controller, respective positions of one or more high pressure control valves positioned on the high pressure extraction conduits and one or more intermediate pressure control valves positioned on the intermediate pressure extraction conduits to balance thrust acting on the rotor.

The present application further provides a steam turbine system. The steam turbine system may include a rotor, a thrust bearing positioned about the rotor, a high pressure section positioned about the rotor, a first high pressure extraction conduit extending from an intermediate stage of the high pressure section, a first control valve positioned on the first high pressure extraction conduit, a second high pressure extraction conduit extending from a last stage of the high pressure section, a second control valve positioned on the second high pressure extraction conduit, an intermediate pressure section positioned about the rotor, a first intermediate pressure extraction conduit extending from a first intermediate stage of the intermediate pressure section, a third control valve positioned on the first intermediate pressure extraction conduit, a second intermediate pressure extraction conduit extending from a second intermediate stage of the intermediate pressure section, a fourth control valve positioned on the second intermediate pressure extraction conduit, and a controller in communication with the first control valve, the second control valve, the third control valve, and the fourth control valve. The controller may be operable to selectively adjust respective positions of the first control valve, the second control valve, the third control valve, and the fourth control valve to balance thrust acting on the rotor.

These and other features and improvements of the present application will become apparent to one of ordinary skill in the art upon review of the following detailed description when taken in conjunction with the several drawings and the appended claims.

DETAILED DESCRIPTION

Figure 1:
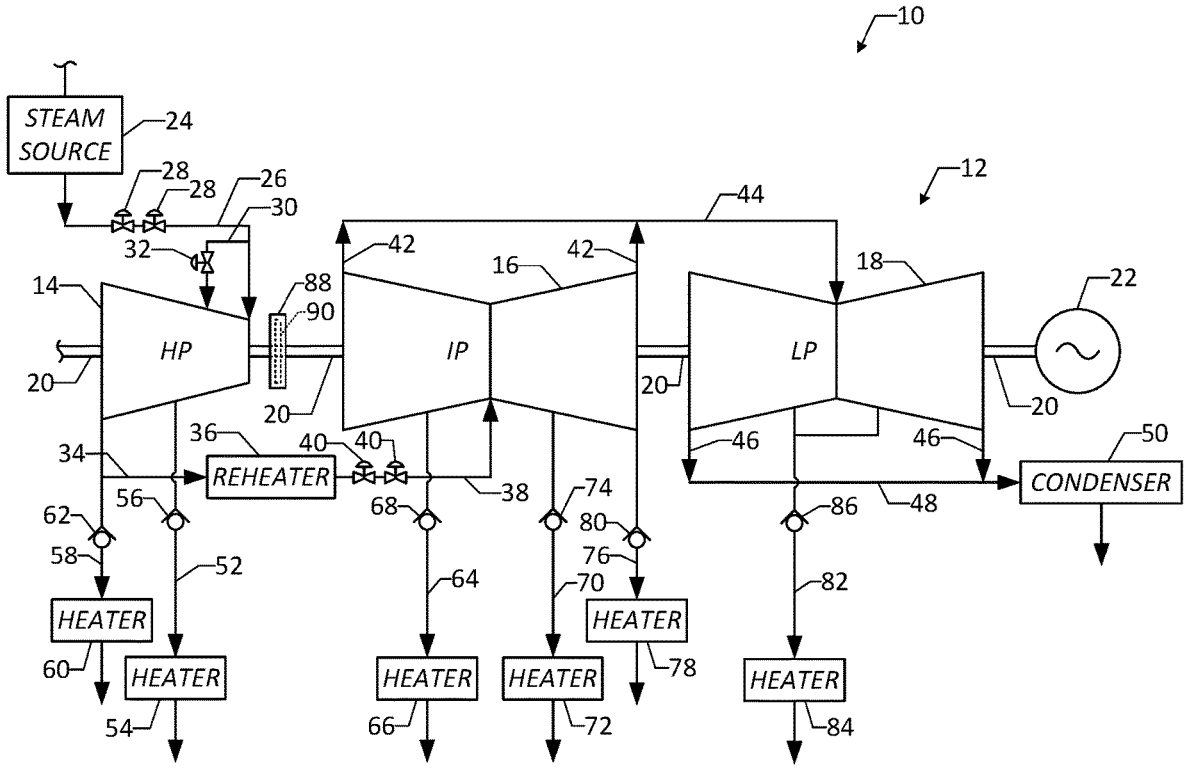
FIG. 1 is a schematic diagram of a steam turbine system including a steam turbine having a high pressure section, an intermediate pressure section, and a low pressure section.

Referring now to the drawings, in which like numerals refer to like elements throughout the several views, FIG. 1 shows a schematic diagram of an example of a steam turbine system 10. The steam turbine system 10 may include a steam turbine 12 having a number of sections. In certain embodiments, as shown, the steam turbine 12 may include a high pressure (HP) section 14, an intermediate pressure (IP) section 16, and a low pressure (LP) section 18. Other sections and other pressures of the steam turbine 12 may be used in other embodiments. The HP section 14, the IP section 16, and the LP section 18 may be positioned about a common rotor 20 of the steam turbine 12 and configured to rotate the rotor 20 during operation of the steam turbine 12. The HP section 14, the IP section 16, and the LP section 18 each may include a number of stages each having a number of stationary nozzles positioned about the rotor 20 and a number of blades configured to rotate with the rotor 20. During operation of the steam turbine 12, rotation of the rotor 20 may drive an electrical generator 22 to produce power. Other components and other configurations of the steam turbine 12 may be used.

As shown, the HP section 14 of the steam turbine 12 may receive high-pressure, high-temperature steam from a steam source 24. In certain embodiments, the steam source 24 may be a boiler, although other components configured to produce steam may be used. The steam may be provided to the HP section 14 via a high pressure (HP) admission conduit 26 extending from the steam source 24 to an inlet of the HP section 14, as shown. One or more high pressure (HP) admission valves 28 may be positioned on the HP admission conduit 26 and configured to selectively control the flow of steam from the steam source 24 to the inlet of the HP section 14. In certain embodiments, the HP admission valves 28 may be control valves, although other types of valves may be used. The steam may flow through the various stages of the HP section 14 such that work is extracted from the steam by rotation of the rotor 20, thereby driving the generator 22. In certain embodiments, as shown, a high pressure (HP) bypass conduit 30 may extend from the HP admission conduit 26 at a location upstream of the inlet of the HP section 14 to an intermediate stage (i.e., a stage after the first stage and before the last stage) of the HP section 14. In this manner, an additional flow of steam may be delivered directly to the intermediate stage of the HP section 14 from the steam source 24. An overload valve 32 may be positioned on the HP bypass conduit 30 and configured to selectively control the additional flow of steam from the steam source 24 to the intermediate stage of the HP section 14. In certain embodiments, the overload valve 32 may be a control valve, although other types of valves may be used. In some embodiments, the HP bypass conduit 30 and the overload valve 32 may be omitted. After flowing through the stages of the HP section 14, the steam may exit the HP section 14 through a high pressure (HP) outlet conduit 34 positioned about the outlet of the HP section 14. In certain embodiments, as shown, at least a portion of the steam exiting the HP section 14 may be directed to a reheater 36 to increase the temperature of the steam.

The IP section 16 of the steam turbine 12 may receive the reheated steam from the reheater 36. The reheated steam may be provided to the IP section 16 via an intermediate pressure (IP) admission conduit 38 extending from the reheater 36 to an inlet of the IP section 16, as shown. One or more intermediate pressure (IP) admission valves 40 may be positioned on the IP admission conduit 38 and configured to selectively control the flow of reheated steam from the reheater 36 to the inlet of the IP section 16. In certain embodiments, the IP admission valves 40 may be control valves, although other types of valves may be used. The steam may flow through the various stages of the IP section 16 such that work is extracted from the steam by rotation of the rotor 20, thereby driving the generator 22. After flowing through the stages of the IP section 16, the steam may exit the IP section 16 through a pair of intermediate pressure (IP) outlet conduits 42 positioned, respectively, about the outlets of the IP section 16. As shown, the steam exiting the IP section 16 may be directed to a crossover conduit 44 via the IP outlet conduits 42.

The LP section 18 of the steam turbine 12 may receive the steam from the IP section 16. The reheated steam may be provided to the LP section 18 via the crossover conduit 44 extending from the IP section 16 to an inlet of the LP section 18, as shown. The steam may flow through the various stages of the LP section 18 such that work is extracted from the steam by rotation of the rotor 20, thereby driving the generator 22. After flowing through the stages of the LP section 18, the steam may exit the LP section 18 through a pair of low pressure (LP) outlet conduits 46 positioned, respectively, about the outlets of the LP section 18. As shown, the steam exiting the LP section 18 may be directed to a condenser inlet conduit 48 via the LP outlet conduits 46. The condenser inlet conduit 48 may direct the steam to a condenser 50 configured to condense the steam into liquid water. The liquid water may be directed from the condenser 50 to the steam source 24, which may convert the liquid water back into steam for subsequent use within the steam turbine 12. In certain embodiments, the liquid water may be directed from the condenser 50, through one or more preheaters 54, 60, 66, 72, 78, 84, and then to the steam source 24.

As shown, the steam turbine system 10 may include a number of extraction conduits configured to extract a number of flows of steam from the HP section 14, the IP section 16, and/or the LP section 18. Although six (6) extraction conduits are shown, with two (2) extraction conduits extending from the HP section 14, three (3) extraction conduits extending from the IP section 16, and one (1) extraction conduit extending from the LP section 18, any number of extraction conduits and any position of the extraction conduits may be used. The extraction conduits may provide steam for various applications, such as pre-heating, boiler feed pump turbine operation, process extraction, district heating extraction, and/or other applications. According to the illustrated embodiment, a first high pressure (HP) extraction conduit 52 may extend from an intermediate stage (i.e., a stage after the first stage and before the last stage) of the HP section 14 and be configured to direct a first high pressure (HP) extraction flow of steam therethrough. In certain embodiments, the first HP extraction conduit 52 may direct the first HP extraction flow of steam to a first preheater 54 configured to use the first HP extraction flow of steam to heat another flow, such as the flow of liquid water from the condenser 50. A first check valve 56 may be positioned on the first HP extraction conduit 52 and configured to allow one-way flow of the first HP extraction flow of steam from the HP section 14 to the first pre-heater 54. A second high pressure (HP) extraction conduit 58 may extend from the last stage of the HP section 14 and be configured to direct a second high pressure (HP) extraction flow of steam therethrough. In certain embodiments, the second HP extraction conduit 58 may direct the second HP extraction flow of steam to a second pre-heater 60 configured to use the second HP extraction flow of steam to heat another flow, such as the flow of liquid water from the condenser 50. A second check valve 62 may be positioned on the second HP extraction conduit 58 and configured to allow one-way flow of the second HP extraction flow of steam from the HP section 14 to the second pre-heater 60.

A first intermediate pressure (IP) extraction conduit 64 may extend from a first intermediate stage (i.e., a stage after the first stage and before the last stage) of the IP section 16 and be configured to direct a first intermediate pressure (IP) extraction flow of steam therethrough. In certain embodiments, the first IP extraction conduit 64 may direct the first IP extraction flow of steam to a third pre-heater 66 configured to use the first IP extraction flow of steam to heat another flow, such as the flow of liquid water from the condenser 50. A third check valve 68 may be positioned on the first IP extraction conduit 64 and configured to allow one-way flow of the first IP extraction flow of steam from the IP section 16 to the third pre-heater 66. A second intermediate pressure (IP) extraction conduit 70 may extend from a second intermediate stage of the IP section 16 and be configured to direct a second intermediate pressure (IP) extraction flow of steam therethrough. In certain embodiments, the second IP extraction conduit 70 may direct the second IP extraction flow of steam to a fourth pre-heater 72 configured to use the second IP extraction flow of steam to heat another flow, such as the flow of liquid water from the condenser 50. A fourth check valve 74 may be positioned on the second IP extraction conduit 70 and configured to allow one-way flow of the second IP extraction flow of steam from the IP section 16 to the fourth pre-heater 72. A third intermediate pressure (IP) extraction conduit 76 may extend from the last stage of the IP section 16 and be configured to direct a third intermediate pressure (IP) extraction flow of steam therethrough. In certain embodiments, the third IP extraction conduit 76 may direct the third IP extraction flow of steam to a fifth pre-heater 78 configured to use the third IP extraction flow of steam to heat another flow, such as the flow of liquid water from the condenser 50. A fifth check valve 80 may be positioned on the third IP extraction conduit 76 and configured to allow one-way flow of the third IP extraction flow of steam from the IP section 16 to the fifth pre-heater 78.

As shown, a first low pressure (LP) extraction conduit 82 may extend from one or more intermediate stages (i.e., stages after the first stage and before the last stage) of the LP section 18 and be configured to direct a first low pressure (LP) extraction flow of steam therethrough. In certain embodiments, the first LP extraction conduit 82 may direct the first LP extraction flow of steam to a sixth pre-heater 84 configured to use the first LP extraction flow of steam to heat another flow, such as the flow of liquid water from the condenser 50. A sixth check valve 86 may be positioned on the first LP extraction conduit 82 and configured to allow one-way flow of the first LP extraction flow of steam from the LP section 18 to the sixth pre-heater 84.

During operation of the steam turbine 12, thrust may be developed by each of the HP section 14, the IP section 16, and the LP section 18, and the sum of these thrust values may result in a net thrust acting on the rotor 20 of the steam turbine 12. As shown, the steam turbine system 10 may include a thrust bearing 88 positioned about the rotor 20. The thrust bearing 88 may be supported by a stationary support structure of the steam turbine 12 such that the axial position of the thrust bearing 88 is maintained during operation of the steam turbine 12. The thrust bearing 88 may be configured to interact with a thrust piston 90 of the rotor 20 during operation of the steam turbine 12. In this manner, the thrust bearing 88 may balance the net thrust acting on the rotor 20 during normal operations of the steam turbine 12. However, during transient operations of the steam turbine 12, the thrust bearing 88 may not effectively balance the net thrust of the steam turbine and may become damaged due to significant increases in steam turbine rotor thrust, such as absolute thrust (+/−) rising above 200 kN. For example, the thrust bearing 88 may be ineffective in balancing the net thrust of the steam turbine when the overload valve 32 is in a fully open position and one or more of the pre-heaters 54, 60, 66, 72, 78, 84 is in an off state.

Figure 2:
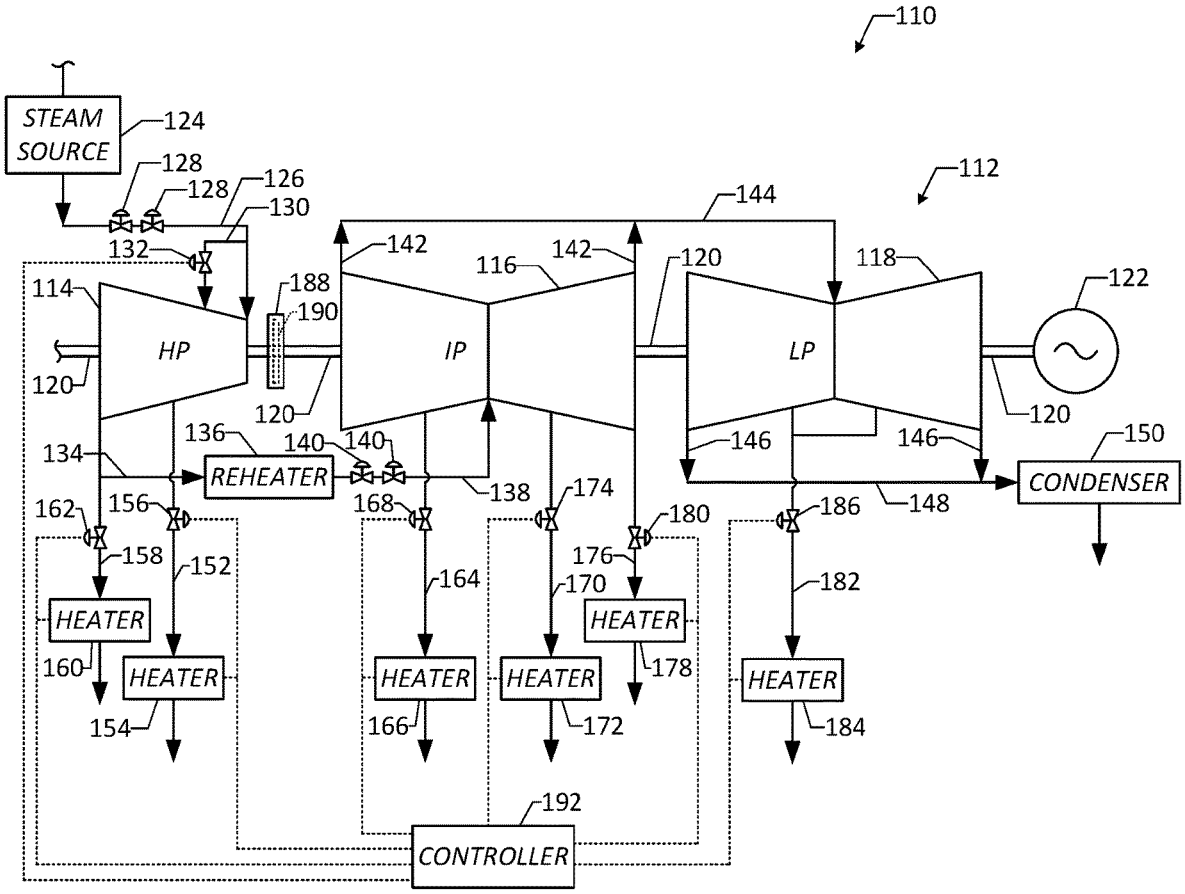
FIG. 2 is a schematic diagram of a steam turbine system as may be described herein, the steam turbine system including a steam turbine having a high pressure section, an intermediate pressure section, and a low pressure section, and a thrust control system for the steam turbine.

FIG. 2 shows an embodiment of a steam turbine system 110 as may be described herein. The steam turbine system 110 may include a steam turbine 112 having a number of sections. In certain embodiments, as shown, the steam turbine 112 may include a high pressure (HP) section 114, an intermediate pressure (IP) section 116, and a low pressure (LP) section 118. Other sections and other pressures of the steam turbine 112 may be used in other embodiments. According to the illustrated embodiment, the HP section 114 is a single-flow HP section, the IP section 116 is a double-flow IP section, and the LP section 118 is a double-flow LP section. It will be appreciated that the HP section 114, the IP section 116, and the LP section 118 may various configurations (e.g., single-flow or double-flow) according to other embodiments. The HP section 114, the IP section 116, and the LP section 118 may be positioned about a common rotor 120 of the steam turbine 112 and configured to rotate the rotor 120 during operation of the steam turbine 112. The HP section 114, the IP section 116, and the LP section 118 each may include a number of stages each having a number of stationary nozzles positioned about the rotor 120 and a number of blades configured to rotate with the rotor 120. During operation of the steam turbine 112, rotation of the rotor 120 may drive an electrical generator 122 to produce power. Other components and other configurations of the steam turbine 112 may be used. As described below, the steam turbine system 110 also may include a thrust control system configured to provide dynamic balancing of steam turbine rotor thrust.

As shown, the HP section 114 of the steam turbine 112 may receive high-pressure, high-temperature steam from a steam source 124. In certain embodiments, the steam source 124 may be a boiler, although other components configured to produce steam may be used. The steam may be provided to the HP section 114 via a high pressure (HP) admission conduit 126 extending from the steam source 124 to an inlet of the HP section 114, as shown. One or more high pressure (HP) admission valves 128 may be positioned on the HP admission conduit 126 and configured to selectively control the flow of steam from the steam source 124 to the inlet of the HP section 114. In certain embodiments, the HP admission valves 128 may be control valves, although other types of valves may be used. The steam may flow through the various stages of the HP section 114 such that work is extracted from the steam by rotation of the rotor 120, thereby driving the generator 122. In certain embodiments, as shown, a high pressure (HP) bypass conduit 130 may extend from the HP admission conduit 126 at a location upstream of the inlet of the HP section 114 to an intermediate stage (i.e., a stage after the first stage and before the last stage) of the HP section 114. In this manner, an additional flow of steam may be delivered directly to the intermediate stage of the HP section 114 from the steam source 124. An overload valve 132 may be positioned on the HP bypass conduit 130 and configured to selectively control the additional flow of steam from the steam source 124 to the intermediate stage of the HP section 114. In certain embodiments, the overload valve 132 may be a control valve, although other types of valves may be used. In some embodiments, the HP bypass conduit 130 and the overload valve 132 may be omitted. After flowing through the stages of the HP section 114, the steam may exit the HP section 114 through a high pressure (HP) outlet conduit 134 positioned about the outlet of the HP section 114. In certain embodiments, as shown, at least a portion of the steam exiting the HP section 114 may be directed to a reheater 136 to increase the temperature of the steam.

The IP section 116 of the steam turbine 112 may receive the reheated steam from the reheater 136. The reheated steam may be provided to the IP section 116 via an intermediate pressure (IP) admission conduit 138 extending from the reheater 136 to an inlet of the IP section 116, as shown. One or more intermediate pressure (IP) admission valves 140 may be positioned on the IP admission conduit 138 and configured to selectively control the flow of reheated steam from the reheater 136 to the inlet of the IP section 116. In certain embodiments, the IP admission valves 140 may be control valves, although other types of valves may be used. The steam may flow through the various stages of the IP section 116 such that work is extracted from the steam by rotation of the rotor 120, thereby driving the generator 122. After flowing through the stages of the IP section 116, the steam may exit the IP section 116 through a pair of intermediate pressure (IP) outlet conduits 142 positioned, respectively, about the outlets of the IP section 116. As shown, the steam exiting the IP section 116 may be directed to a crossover conduit 144 via the IP outlet conduits 142.

The LP section 118 of the steam turbine 112 may receive the steam from the IP section 116. The reheated steam may be provided to the LP section 118 via the crossover conduit 144 extending from the IP section 116 to an inlet of the LP section 118, as shown. The steam may flow through the various stages of the LP section 118 such that work is extracted from the steam by rotation of the rotor 120, thereby driving the generator 122. After flowing through the stages of the LP section 118, the steam may exit the LP section 118 through a pair of low pressure (LP) outlet conduits 146 positioned, respectively, about the outlets of the LP section 118. As shown, the steam exiting the LP section 118 may be directed to a condenser inlet conduit 148 via the LP outlet conduits 146. The condenser inlet conduit 148 may direct the steam to a condenser 150 configured to condense the steam into liquid water. The liquid water may be directed from the condenser 150 to the steam source 124, which may convert the liquid water back into steam for subsequent use within the steam turbine 112. In certain embodiments, the liquid water may be directed from the condenser 150, through one or more pre-heaters 154, 160, 166, 172, 178, 184, and then to the steam source 124.

As shown, the steam turbine system 110 may include a number of extraction conduits configured to extract a number of flows of steam from the HP section 114, the IP section 116, and/or the LP section 118. Although six (6) extraction conduits are shown, with two (2) extraction conduits extending from the HP section 114, three (3) extraction conduits extending from the IP section 116, and one (1) extraction conduit extending from the LP section 118, any number of extraction conduits and any position of the extraction conduits may be used. The extraction conduits may provide steam for various applications, such as pre-heating, boiler feed pump turbine operation, process extraction, district heating extraction, and/or other applications. According to the illustrated embodiment, a first high pressure (HP) extraction conduit 152 may extend from an intermediate stage (i.e., a stage after the first stage and before the last stage) of the HP section 114 and be configured to direct a first high pressure (HP) extraction flow of steam therethrough. In certain embodiments, the first HP extraction conduit 152 may direct the first HP extraction flow of steam to a first pre-heater 154 configured to use the first HP extraction flow of steam to heat another flow, such as the flow of liquid water from the condenser 150. A first control valve 156 may be positioned on the first HP extraction conduit 152 and configured to selectively control the flow of the first HP extraction flow of steam from the HP section 114 to the first pre-heater 154. A second high pressure (HP) extraction conduit 158 may extend from the last stage of the HP section 114 and be configured to direct a second high pressure (HP) extraction flow of steam therethrough. In certain embodiments, the second HP extraction conduit 158 may direct the second HP extraction flow of steam to a second pre-heater 160 configured to use the second HP extraction flow of steam to heat another flow, such as the flow of liquid water from the condenser 150. A second control valve 162 may be positioned on the second HP extraction conduit 158 and configured to selectively control the flow of the second HP extraction flow of steam from the HP section 114 to the second pre-heater 160.

A first intermediate pressure (IP) extraction conduit 164 may extend from a first intermediate stage (i.e., a stage after the first stage and before the last stage) of the IP section 116 and be configured to direct a first intermediate pressure (IP) extraction flow of steam therethrough. In certain embodiments, the first IP extraction conduit 164 may direct the first IP extraction flow of steam to a third pre-heater 166 configured to use the first IP extraction flow of steam to heat another flow, such as the flow of liquid water from the condenser 150. A third control valve 168 may be positioned on the first IP extraction conduit 164 and configured to selectively control the flow of the first IP extraction flow of steam from the IP section 116 to the third pre-heater 166. A second intermediate pressure (IP) extraction conduit 170 may extend from a second intermediate stage of the IP section 116 and be configured to direct a second intermediate pressure (IP) extraction flow of steam therethrough. In certain embodiments, the second IP extraction conduit 170 may direct the second IP extraction flow of steam to a fourth pre-heater 172 configured to use the second IP extraction flow of steam to heat another flow, such as the flow of liquid water from the condenser 150. A fourth control valve 174 may be positioned on the second IP extraction conduit 170 and configured to selectively control the flow of the second IP extraction flow of steam from the IP section 116 to the fourth pre-heater 172. A third intermediate pressure (IP) extraction conduit 176 may extend from the last stage of the IP section 116 and be configured to direct a third intermediate pressure (IP) extraction flow of steam therethrough. In certain embodiments, the third IP extraction conduit 176 may direct the third IP extraction flow of steam to a fifth pre-heater 178 configured to use the third IP extraction flow of steam to heat another flow, such as the flow of liquid water from the condenser 150. A fifth control valve 180 may be positioned on the third IP extraction conduit 176 and configured to selectively control the flow of the third IP extraction flow of steam from the IP section 116 to the fifth pre-heater 178.

As shown, a first low pressure (LP) extraction conduit 182 may extend from one or more intermediate stages (i.e., stages after the first stage and before the last stage) of the LP section 118 and be configured to direct a first low pressure (LP) extraction flow of steam therethrough. In certain embodiments, the first LP extraction conduit 182 may direct the first LP extraction flow of steam to a sixth pre-heater 184 configured to use the first LP extraction flow of steam to heat another flow, such as the flow of liquid water from the condenser 150. A sixth control valve 186 may be positioned on the first LP extraction conduit 182 and configured to allow one-way flow of the first LP extraction flow of steam from the LP section 118 to the sixth pre-heater 184.

During operation of the steam turbine 112, thrust may be developed by each of the HP section 114, the IP section 116, and the LP section 118, and the sum of these thrust values may result in a net thrust acting on the rotor 120 of the steam turbine 112. As shown, the steam turbine system 110 may include a thrust bearing 188 positioned about the rotor 120. The thrust bearing 188 may be supported by a stationary support structure of the steam turbine 112 such that the axial position of the thrust bearing 188 is maintained during operation of the steam turbine 112. The thrust bearing 188 may be configured to interact with a thrust piston 190 of the rotor 120 during operation of the steam turbine 112. In this manner, the thrust bearing 188 may balance the net thrust acting on the rotor 120 during normal operations of the steam turbine 112.

As shown, the steam turbine system 110 also may include an electronic controller 192 in operable communication with the overload valve 132, the first pre-heater 154, the second pre-heater 160, the third pre-heater 166, the fourth pre-heater 172, the fifth pre-heater 178, the sixth pre-heater 184, the first control valve 156, the second control valve 162, the third control valve 168, the fourth control valve 174, the fifth control valve 180, and the sixth control valve 186. The controller 192 may be electrically and/or communicatively coupled to the pre-heaters 154, 160, 166, 172, 178, 184 and the control valves 156, 162, 168, 174, 180, 186 and may provide a digital-industrial solution for controlling operation of such components. As used herein, the term "controller" refers to a device that receives input signals corresponding to the operating position or operating state of one or more first components and sends output signals corresponding to the operating position or operating state of one or more second components to control the operating position or operating state of the one or more second components. The controller 192 may include one or more processors and/or memory components. The controller 192 may be implemented as appropriate in hardware, software, firmware, or combinations thereof. Software or firmware implementations of the controller 192 may include computer-executable or machine-executable instructions written in any suitable programming language to perform the various functions described herein. Hardware implementations of the controller 192 may be configured to execute computer-executable or machine-executable instructions to perform the various functions described herein. The controller 192 may include, without limitation, a central processing unit (CPU), a digital signal processor (DSP), a reduced instruction set computer (RISC), a complex instruction set computer (CISC), a microprocessor, a microcontroller, a field programmable gate array (FPGA), or any combination thereof. In some embodiments, the controller 192 may be a steam turbine system controller operable to control various aspects of the steam turbine system 110. In some embodiments, the controller 192 may be a power plant system controller operable to control various aspects of an overall power plant including the steam turbine system 110. In some embodiments, the controller 192 may be part of a digital command control (DCC) system configured to digitally control the operations described herein.

The controller 192 may be operable to dynamically control and balance steam turbine rotor thrust during transient operations of the steam turbine 112. For example, the controller 192 may effectively control and balance the steam turbine's net thrust when the overload valve 132 is in a fully open position and/or one or more of the pre-heaters 154, 160, 166, 172, 178, 184 is in an off state. In particular, the controller 192 may dynamically control the extraction flows of steam flowing from the HP section 114, the IP section 116, and/or the LP section 118 to the respective pre-heaters 154, 160, 166, 172, 178, 184 by selectively adjusting the position (i.e., an "on" or "open" position, an "off" or "closed" position, or an "intermediate" or "partially closed" position in between the "on" or "open" position and the "off" or "closed" position) of one or more of the control valves 156, 162, 168, 174, 180, 186, based on the position (i.e., an "on" or "open" position, an "off" or "closed" position, or an "intermediate" or "partially closed" position in between the "on" or "open" position and the "off" or "closed" position) of the overload valve 132 and/or the operating state (i.e., an "on" state or an "off" state) of one or more or the pre-heaters 154, 160, 166, 172, 178, 184. In this manner, the dynamic control provided by the controller 192 may maintain the steam turbine's net thrust within a desired predetermined range, such that the thrust bearing 188 is not damaged due to thrust increases during transient operations of the steam turbine 112. The control valves 156, 162, 168, 174, 180, 186, the thrust bearing 188, and the controller 192 may collectively form a thrust control system of the steam turbine system 110.

The controller 192 may receive one or more input signals from one or more of the pre-heaters 154, 160, 166, 172, 178, 184 and the control valves 156, 162, 168, 174, 180, 186, indicating an operating state or an operating position thereof. Based at least in part on such input signals, the controller may send one or more output signals to one or more of the pre-heaters 154, 160, 166, 172, 178, 184 and the control valves 156, 162, 168, 174, 180, 186, directing such components to assume a desired operating state or operating position. In this manner, the controller 192 may control the respective operating states of the pre-heaters 154, 160, 166, 172, 178, 184 and the operating positions of the control valves 156, 162, 168, 174, 180, 186 in various operating configurations in order to maintain the steam turbine's net thrust within a desired predetermined range.

For example, if the steam turbine system 110 was operated in a configuration in which the fourth pre-heater 172 is in the off state (i.e., the fourth control valve 174 is in the off or closed position) and the third pre-heater 166 is in the on state (i.e., the third control valve 168 is in the on or open position), the resulting thrust increase may be undesirably high and/or the steam turbine's net thrust may be outside of the desired range. In certain embodiments, the controller 192 may be operable to direct the third pre-heater 166 to assume the off state when the fourth pre-heater 172 is in the off state. In other words, the controller 192 may be operable to direct the third control valve 168 to assume the off or closed position when the fourth control valve 174 is in the off or closed position. In certain embodiments, a partially closed position may be used, depending on required thrust balance. For example, the controller 192 may be operable to direct the third control valve 168 to assume the off or closed position or the partially closed position when the fourth control valve 174 is in the off or closed position. In this manner, the controller 192 may prevent the undesirably high thrust increase and/or may maintain the steam turbine's net thrust within the desired range, such that the thrust bearing 188 is not damaged.

As another example, if the steam turbine system 110 was operated in a configuration in which the third pre-heater 166 is in the off state (i.e., the third control valve 168 is in the off or closed position) and the fourth pre-heater 172 is in the on state (i.e., the fourth control valve 174 is in the on or open position), the resulting thrust increase may be undesirably high and/or the steam turbine's net thrust may be outside of the desired range. In certain embodiments, the controller 192 may be operable to direct the fourth pre-heater 172 to assume the off state when the third pre-heater 166 is in the off state. In other words, the controller 192 may be operable to direct the fourth control valve 174 to assume the off or closed position when the third control valve 168 is in the off or closed position. In certain embodiments, a partially closed position may be used, depending on required thrust balance. For example, the controller 192 may be operable to direct the fourth control valve 174 to assume the off or closed position or the partially closed position when the third control valve 168 is in the off or closed position. In this manner, the controller 192 may prevent the undesirably high thrust increase and/or may maintain the steam turbine's net thrust within the desired range, such that the thrust bearing 188 is not damaged.

As a further example, if the steam turbine system 110 was operated in a configuration in which the overload valve 132 is in the fully open position and the first pre-heater 154 is in the on state (i.e., the first control valve 156 is in the on or open position), the resulting thrust increase may be undesirably high and/or the steam turbine's net thrust may be outside of the desired range. In certain embodiments, the controller 192 may be operable to direct the second pre-heater 160 to assume the on state, to direct the third pre-heater 166 to assume the on state, and to direct the fourth pre-heater 172 to assume the off state when the overload valve 132 is in the fully open position and the first pre-heater 154 is in the on state. In other words, the controller 192 may be operable to direct the second control valve 162 to assume the on or open position, to direct the third control valve 164 to assume the on or open position, and to direct the fourth control valve 174 to assume the off or closed position when the overload valve 132 is in the fully open position and the first control valve 156 is in the on or open position. In this manner, the controller 192 may prevent the undesirably high thrust increase and/or may maintain the steam turbine's net thrust within the desired range, such that the thrust bearing 188 is not damaged. In certain embodiments, the controller 192 may be operable to direct the second pre-heater 160 to assume the off state, to direct the third pre-heater 166 to assume the on state, and to direct the fourth pre-heater 172 to assume the off state when the overload valve 132 is in the fully open position and the first pre-heater 154 is in the on state. In other words, the controller 192 may be operable to direct the second control valve 162 to assume the off or closed position, to direct the third control valve 164 to assume the on or open position, and to direct the fourth control valve 174 to assume the off or closed position when the overload valve 132 is in the fully open position and the first control valve 156 is in the on or open position. In this manner, the controller 192 may prevent the undesirably high thrust increase and/or may maintain the steam turbine's net thrust within the desired range, such that the thrust bearing 188 is not damaged.

As another example, if the steam turbine system 110 was operated in a configuration in which the overload valve 132 is in the fully open position and the first pre-heater 154, the second pre-heater 160, the third pre-heater 166, and the fourth pre-heater 172 each are in the on state (i.e., the first control valve 156, the second control valve 162, the third control valve 168, and the fourth control valve 174 each are in the on or open position), the resulting thrust increase may be undesirably high and/or the steam turbine's net thrust may be outside of the desired range. In certain embodiments, the controller 192 may be operable to direct the fourth pre-heater 172 to assume the off state when the overload valve 132 is in the fully open position and the first pre-heater 154, the second pre-heater 160, and the third pre-heater 166 each are in the on state. In other words, the controller 192 may be operable to direct the fourth control valve 174 to assume the off or closed position when the overload valve 132 is in the fully open position and the first control valve 156, the second control valve 162, and the third control valve 168 each are in the on or open position. In this manner, the controller 192 may prevent the undesirably high thrust increase and/or may maintain the steam turbine's net thrust within the desired range, such that the thrust bearing 188 is not damaged. In certain embodiments, the controller 192 may be operable to direct the second pre-heater 160 and the fourth pre-heater 172 each to assume the off state when the overload valve 132 is in the fully open position and the first pre-heater 154 and the third pre-heater 166 each are in the on state. In other words, the controller 192 may be operable to direct the second control valve 162 and the fourth control valve 174 each to assume the off or closed position when the overload valve 132 is in the fully open position and the first control valve 156 and the third control valve 168 each are in the on or open position. In this manner, the controller 192 may prevent the undesirably high thrust increase and/or may maintain the steam turbine's net thrust within the desired range, such that the thrust bearing 188 is not damaged.

Figure 3:
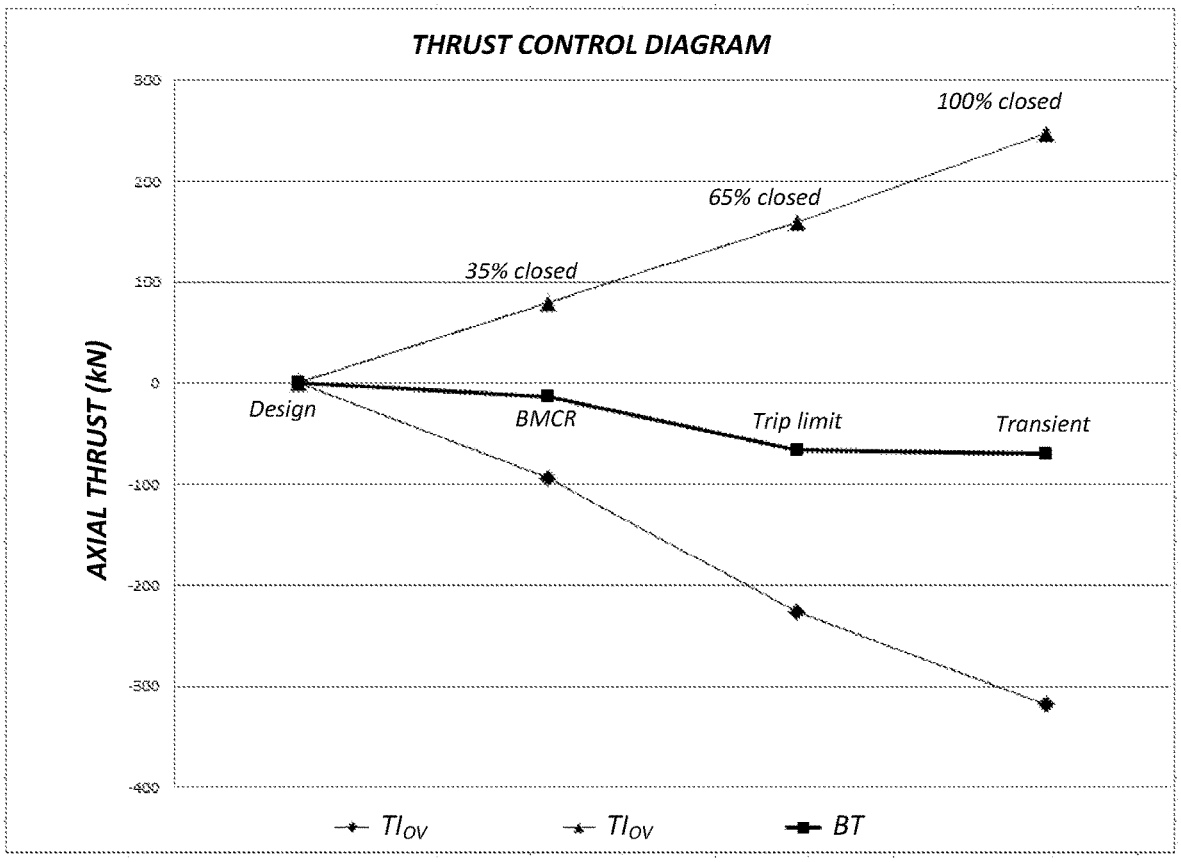
FIG. 3 is a thrust control diagram of an example use of the steam turbine system of FIG. 2, illustrating the impact of a position of a control valve on an extraction conduit, the impact of a position of an overload valve on a bypass conduit, and the resulting balanced thrust.

FIG. 3 is a thrust control diagram of an example use of the steam turbine system 110. In particular, the thrust control diagram illustrates the thrust impact $TI_{CV}$ of the position of the fourth control valve 174, the thrust impact $TI_{OV}$ of the position of the overload valve 132, and the resulting balanced thrust BT during operation of the steam turbine 112. As shown, at various operating states of the steam turbine 112, the thrust impact $TI_{CV}$ of the position of the fourth control valve 174 may balance or substantially balance the thrust impact $TI_{OV}$ of the position of the overload valve 132, such that the balanced thrust BT is maintained within a desired predetermined range. When the steam turbine 112 operates at its boiler maximum continuous rating (BMCR), the overload valve 132 may be in a partially open position, and the fourth control valve 174 may be in a partially closed position. For example, the fourth control valve 174 may be in a 35% closed position. When the steam turbine 112 operates at its trip limit, the overload valve 132 may be in a partially open position, and the fourth control valve 174 may be in a partially closed position. For example, the fourth control valve 174 may be in a 65% closed position. During transient operation of the steam turbine 112, the overload valve 132 may be in a fully open position (i.e., 100% open position), and the fourth control valve 174 may be in a fully closed position (i.e., 100% closed position). In this manner, the position of the fourth control valve 174 may be adjusted, via the controller 192 as described above, based at least in part on the position of the overload valve 132, such that the thrust impact $TI_{CV}$ of the position of the fourth control valve 174 balances or substantially balances the thrust impact $TI_{OV}$ of the position of the overload valve 132 and the resulting balanced thrust BT is maintained within a desired predetermined range.

The steam turbine system 110 and related methods described herein thus provide improved systems and methods for balancing of steam turbine rotor thrust during both normal operations and transient operations. As described above, the control valves 156, 162, 168, 174, 180, 186, the thrust bearing 188, and the controller 192 of the steam turbine system 110 may collectively form a thrust control system which provides dynamic balancing of steam turbine rotor thrust in a cost-effective manner that minimizes mechanical losses of the steam turbine 112 and improves the heat rate. Additionally, the steam turbine system 110 and methods described herein may allow for the use of a conventional thrust bearing 188 in a size that minimizes leakage from the thrust piston 190 and thus provides improved efficiency of the steam turbine 112. Furthermore, the steam turbine system 110 and methods described herein may inhibit damage to the thrust bearing 188 and allow the steam turbine 112 to operate in a safe and reliable manner.

It should be apparent that the foregoing relates only to certain embodiments of the present application. Numerous changes and modifications may be made herein by one of ordinary skill in the art without departing from the general spirit and scope of the invention as defined by the following claims and the equivalents thereof.

I claim:

1. A steam turbine system, comprising:

a rotor;

a high pressure section positioned about the rotor;

an overload valve positioned on a high pressure bypass conduit;

a plurality of high pressure extraction conduits extending from the high pressure section, wherein each of the high pressure extraction conduits is configured to direct a high pressure extraction flow of steam;

a plurality of high pressure control valves each positioned on a respective one of the high pressure extraction conduits, the high pressure control valves comprising a first high pressure control valve and a second high pressure control valve;

an intermediate pressure section positioned about the rotor;

a plurality of intermediate pressure extraction conduits extending from the intermediate pressure section, wherein each of the intermediate pressure extraction conduits is configured to direct an intermediate pressure extraction flow of steam;

a plurality of intermediate pressure control valves each positioned on a respective one of the intermediate pressure extraction, conduits, the intermediate pressure control valves comprising a first intermediate pressure control valve and a second intermediate pressure control valve; and a controller in communication with the overload valve, the high pressure control valves, and the intermediate pressure control valves, wherein the controller is configured to:

direct the second high pressure control valve to an open position;

direct the first intermediate pressure control valve to an open position; and direct the second intermediate pressure control valve to a closed position;

wherein the directing of the respective positions of the second high pressure control valve, the first intermediate pressure control valve, and the second intermediate control valve occurs when the overload valve is in a fully open position and the first high pressure control valve is in an open position, such that a net thrust of the steam turbine system is balanced within a predefined range.

2. The steam turbine system of claim 1, further comprising a thrust bearing positioned about the rotor and configured to interact with a thrust piston of the rotor.

3. The steam turbine system of claim 1, wherein the controller is operable to selectively adjust the respective positions of the high pressure control valves and the intermediate pressure control valves to maintain the thrust acting on the rotor within the predefined range.

4. The steam turbine system of claim 1, further comprising:

a high pressure admission conduit extending from a steam source to an inlet of the high pressure section;

wherein the high pressure bypass conduit extends from the high pressure admission conduit to an intermediate stage of the high pressure section.

5. The steam turbine system of claim 4, wherein the controller is operable to selectively adjust the position of one of the high pressure control valves and the intermediate pressure control valves based at least in part on the respective positions of a remainder of the high pressure control valves and the intermediate pressure control valves and a position of the overload valve.

6. The steam turbine system of claim 1, wherein the high pressure extraction conduits comprise a first high pressure extraction conduit extending from an intermediate stage of the high pressure section and a second high pressure extraction conduit extending from a last stage of the high pressure section, wherein the first high pressure control valve is positioned on the first high pressure extraction conduit and the second high pressure control valve is positioned on the second high pressure extraction conduit.

7. The steam turbine system of claim 6, wherein the intermediate pressure extraction conduits comprise a first intermediate pressure extraction conduit extending from a first intermediate stage of the intermediate pressure section and a second intermediate pressure extraction conduit extending from a second intermediate stage of the intermediate pressure section, wherein the first intermediate pressure control valve is positioned on the first intermediate pressure extraction conduit and the second intermediate pressure control valve is positioned on the second intermediate pressure extraction conduit.

8. The steam turbine system of claim 1, wherein the controller is operable to direct the first intermediate pressure control valve to assume a closed position or a partially closed position when the second intermediate pressure control valve is in the closed position, and wherein the controller is operable to direct the second intermediate pressure control valve to assume the closed position or a partially closed position when the first intermediate pressure control valve is in the closed position.

9. The steam turbine system of claim 7, wherein the first high pressure extraction conduit is configured to direct a first high pressure extraction flow of steam to a first pre-heater, wherein the second high pressure extraction conduit is configured to direct a second high pressure extraction flow of steam to a second pre-heater, wherein the first intermediate pressure extraction conduit is configured to direct a first intermediate pressure extraction flow of steam to a third pre-heater, and wherein the second intermediate pressure extraction conduit is configured to direct a second intermediate pressure extraction flow of steam to a fourth pre-heater.

10. The steam turbine system of claim 1, wherein the controller is further operable to direct the second intermediate pressure control valve to assume the closed position or a partially closed position when the overload valve is in the fully open position, the first high pressure control valve is in the open position, the second high pressure control valve is in the open position, and the first intermediate pressure control valve is in the open position.

11. The steam turbine system of claim 1, wherein the controller is operable to direct the second high pressure control valve to assume a closed position or a partially closed position, to direct the first intermediate pressure control valve to assume the open position, and to direct the second intermediate pressure control valve to assume the closed position or a partially closed position when the overload valve is in the fully open position and the first high pressure control valve is in the open position.

12. The steam turbine system of claim 1, wherein the controller is operable to direct the second high pressure control valve to assume a closed position or a partially closed position and to direct the second intermediate pressure control valve to assume the closed position or a partially closed position when the overload valve is in the fully open position and the first high pressure control valve and the intermediate pressure control valve each are in the open position.

13. The steam turbine system of claim 1, further comprising:

a low pressure section positioned about the rotor;

a low pressure extraction conduit extending from the low pressure section and configured to direct one or more low pressure extraction flows of steam; and a low pressure control valve positioned on the low pressure extraction conduit;

wherein the controller is in communication with the overload valve and the low pressure control valve, and wherein the controller is operable to selectively adjust respective positions of the high pressure control valves, the one or more intermediate pressure control valves, and the low pressure control valve based at least in part on a respective position of the overload valve.

14. A steam turbine system, comprising:

a rotor;

a thrust bearing positioned about the rotor;

a high pressure section positioned about the rotor;

an overload valve positioned on a high pressure bypass conduit;

a first high pressure extraction conduit extending from an intermediate stage of the high pressure section;

a first high pressure control valve positioned on the first high pressure extraction conduit;

a second high pressure extraction conduit extending from a last stage of the high pressure section;

a second high pressure control valve positioned on the second high pressure extraction conduit;

an intermediate pressure section positioned about the rotor;

a first intermediate pressure extraction conduit extending from a first intermediate stage of the intermediate pressure section;

a first intermediate pressure control valve positioned on the first intermediate pressure extraction conduit;

a second intermediate pressure extraction conduit extending from a second intermediate stage of the intermediate pressure section;

a second intermediate pressure control valve positioned on the second intermediate pressure extraction conduit; and a controller in communication with the overload valve, the first high pressure control valve, the second high pressure control valve, the first intermediate pressure control valve, and the second intermediate pressure control valve, wherein the controller is configured to:

direct the second high pressure control valve to an open position;

direct the first intermediate pressure control valve to an open position; and direct the second intermediate pressure control valve to a closed position;

wherein the directing of the respective positions of the second high pressure control valve, the first intermediate pressure control valve, and the second intermediate pressure control valve occurs when the overload valve is in a fully open position and the first high pressure control valve is in an open position, such that a net thrust of the steam turbine system is balanced within a predefined range.

15. The steam turbine system of claim 14, wherein the controller is operable to direct the first intermediate pressure control valve to assume a closed position or a partially closed position when the second intermediate pressure control valve is in the closed position, and wherein the controller is operable to direct the second intermediate pressure control valve to assume the closed position or a partially closed position when the first intermediate pressure control valve is in the closed position.

16. The steam turbine system of claim 14, further comprising:

a high pressure admission conduit extending from a steam source to an inlet of the high pressure section;

wherein the high pressure bypass conduit extends from the high pressure admission conduit to an intermediate stage of the high pressure section;

wherein the overload valve is positioned on the high pressure bypass conduit; and wherein the controller is operable to selectively adjust the position of one of the first high pressure control valve, the second high pressure control valve, the first intermediate pressure control valve, and the second intermediate pressure control valve based at least in part on the respective positions of a remainder of the first high pressure control valve, the second high pressure control valve, the first intermediate pressure control valve, and the second intermediate pressure control valve and a position of the overload valve.

17. The steam turbine system of claim 16, wherein the controller is operable to direct the second intermediate pressure control valve to assume the closed position or the partially closed position when the overload valve is in the fully open position, the first high pressure control valve is in the open position, the second high pressure control valve is in the open position, and the first intermediate pressure control valve is in the open position.

18. The steam turbine system of claim 14, wherein the first high pressure extraction conduit is configured to direct a first high pressure extraction flow of steam to a first pre-heater, wherein the second high pressure extraction conduit is configured to direct a second high pressure extraction flow of steam to a second pre-heater, wherein the first intermediate pressure extraction conduit is configured to direct a first intermediate pressure extraction flow of steam to a third pre-heater, and wherein the second intermediate pressure extraction conduit is configured to direct a second intermediate pressure extraction flow of steam to a fourth pre-heater.

* * * * *